US006837746B2

(12) United States Patent
Okamoto

(10) Patent No.: US 6,837,746 B2
(45) Date of Patent: Jan. 4, 2005

(54) INSERT-MOLDED CONNECTOR AND METHOD OF FORMING IT

(75) Inventor: Masaki Okamoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/607,097

(22) Filed: Jun. 25, 2003

(65) Prior Publication Data

US 2004/0002260 A1 Jan. 1, 2004

(30) Foreign Application Priority Data

Jun. 28, 2002 (JP) ..... 2002-190856

(51) Int. Cl.[7] ..... H01R 13/58
(52) U.S. Cl. ..... 439/606; 264/263; 264/277
(58) Field of Search ..... 439/606, 604, 439/516, 511, 76.1, 66; 29/883, 882, 874; 264/263, 271, 277, 275

(56) References Cited

U.S. PATENT DOCUMENTS 5,038,468 A * 8/1991 Wanatowicz ..... 29/882
5,823,797 A * 10/1998 Sugiyama ..... 439/76.1
5,926,952 A * 7/1999 Ito ..... 29/883
6,007,387 A 12/1999 Uchiyama
6,076,258 A * 6/2000 Abe ..... 29/883
6,371,808 B2 * 4/2002 Sakaguchi ..... 439/604
6,447,331 B1 * 9/2002 Fukatsu et al. ..... 439/516

FOREIGN PATENT DOCUMENTS

JP 7-11771 2/1995

* cited by examiner

*Primary Examiner*—Gary Paumen
*Assistant Examiner*—Edwin A. Leon
(74) *Attorney, Agent, or Firm*—Gerald E. Hespos; Anthony J. Casella

(57) ABSTRACT

A housing (10) is insert-molded around a core (30) holding terminal fittings (20). The core (30) is provided with a holdable portion (36) at a position exposed to outside through an opening (13) formed in the housing (10) and held in a molding die (50). Thus, the core (30) is prevented from displacements from its a proper position upon being subjected to an injection pressure of a resin. Further, the holdable portion (36) is located in a sealed area of a connector fitting portion (11) defined between the connector fitting portion (11) and a mating female connector (40), the entrance of water through the opening (13) can be prevented.

10 Claims, 9 Drawing Sheets

INSERT-MOLDED CONNECTOR AND METHOD OF FORMING IT

BACKGROUND OF THE INVENTION

1. Field of the Invention

The invention relates to an insert-molded connector and to a method of molding or forming it.

2. Description of the Related Art

Japanese Unexamined Utility Model Publication No. 7-11771 and FIG. 9 herein disclose an insert-molded connector. With reference to FIG. 9, the connector has L-shaped terminal fittings 1 insert molded into a housing 2 and connector portions 3 are provided at the opposite ends of the housing 2. The connector is used, for example, as an intermediate connector. The connector is insert molded by positioning the terminal fittings 1 in a cavity of a molding die so that the ends of the terminal fittings 1 are inserted into mount grooves in a wall of the cavity. A synthetic resin then is injected into the cavity to mold the housing 2. However, terminal fittings 1 that are long are likely to be deformed by the injection pressure of the resin. As a result, the projecting distance of the terminal fittings 1 in the connector portions 3 may vary or the terminal fittings 1 may be brought into contact with each other in an extreme case.

U.S. Pat. No. 6,007,387 and FIG. 10 herein disclose a connector that attempts to address the above-described problem. The connector shown in FIG. 10 incorporates terminal fittings 5 into a core 6 to define a core assembly in which the core 6 holds the terminal fittings 5. A housing 7 then is inserted molded around the core assembly. Thus, the injection pressure of the resin is unlikely to deform the terminal fittings 5. However, the molding die is constructed to hold only the terminal fittings 5 of the core assembly. Thus, there is a possibility that the core 6 will displace from a proper position in response to the injection pressure of the resin. As a result, the terminal fittings 5 may be deformed to cause a molding failure.

The present invention was developed in view of the above problems and an object thereof is to prevent an occurrence of a molding failure.

SUMMARY OF THE INVENTION

The invention is directed to a connector formed by insert-molding a housing at least partly covering a core that holds one or more terminal fittings as a core assembly. The core comprises a holdable portion to be held by a molding die at a position at least partly exposed from the housing. Accordingly, the injection pressure of the resin will not displace the core from the proper position. Thus, the connector can be prevented from molding failures.

The housing preferably comprises a connector-fitting portion engageable with a mating connector. The holdable portion is located in a sealed area of the connector-fitting portion defined between the connector-fitting portion and the mating connector. The housing preferably is formed with an opening for exposing the holdable portion of the core. As a result, water may intrude into a small clearance between the core and the housing through the opening if the connector is used in a place where it is exposed to water. However, the holdable portion is in the sealed area of the connector-fitting portion, and the entrance of water through the opening can be prevented.

The housing and the core preferably are molded of synthetic resins having different colors or external appearance. The core and the terminal fittings could be set at improper positions in the molding die during insert molding of the housing. In this situation, the resin for forming the housing enters the region where the holdable portion of the core should be located, thereby covering the holdable portion. In such a defectively molded article, the color of the resin of the housing is seen instead of that of the resin of the core at the specified positions of the holdable portion. Thus, an improper molding can be detected by looking at the positions where the holdable portion of the molded article should be to check the color or external appearance.

The molding die preferably comprises a holding portion having a shape mating the holdable portion at the core and engageable therewith.

The core preferably comprises at least two holding members for holding the terminal fittings. Most preferably, the holding members comprise interlocking means for interlocking the holding members to each other.

The invention also relates to a method of molding an insert-molded connector. The method comprises providing a core holding one or more terminal fittings as a core assembly, arranging a molding die substantially around the core so that the molding die holds a holdable portion of the core, and molding a housing at least partly covering the core within the molding die.

The method may further comprise molding the housing and the core of synthetic resins having different colors or different external appearances.

The core preferably comprises first and second holding members and the method preferably comprises fitting terminal fittings into a terminal mounting groove of the first holding member and then fitting the second holding member to the mounting surface of the first holding member to hold the respective terminal fittings clamped or sandwiched between the holding members.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
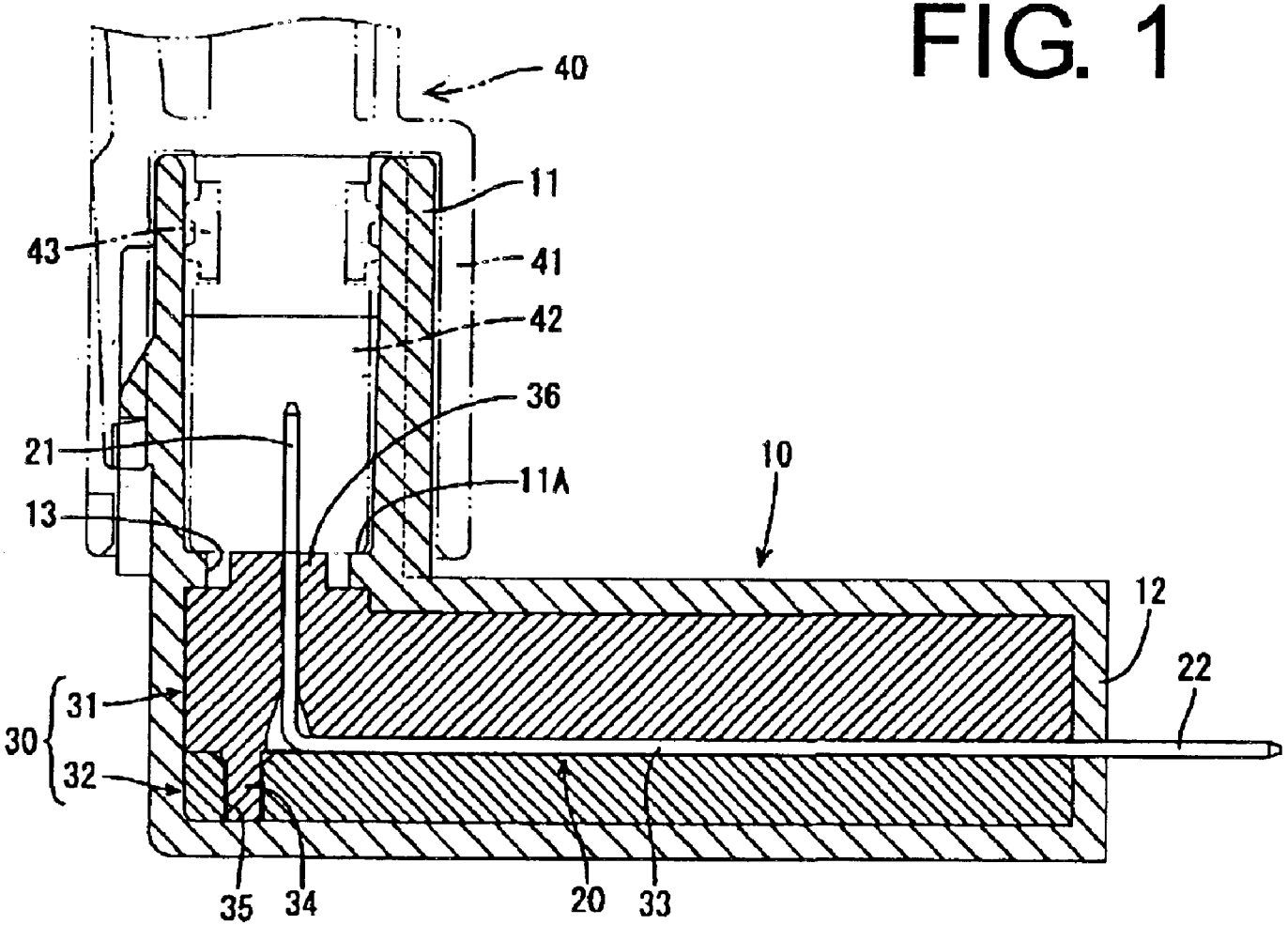
FIG. 1 is a side view in section showing a connector according to a first embodiment of the invention.
Figure 2:
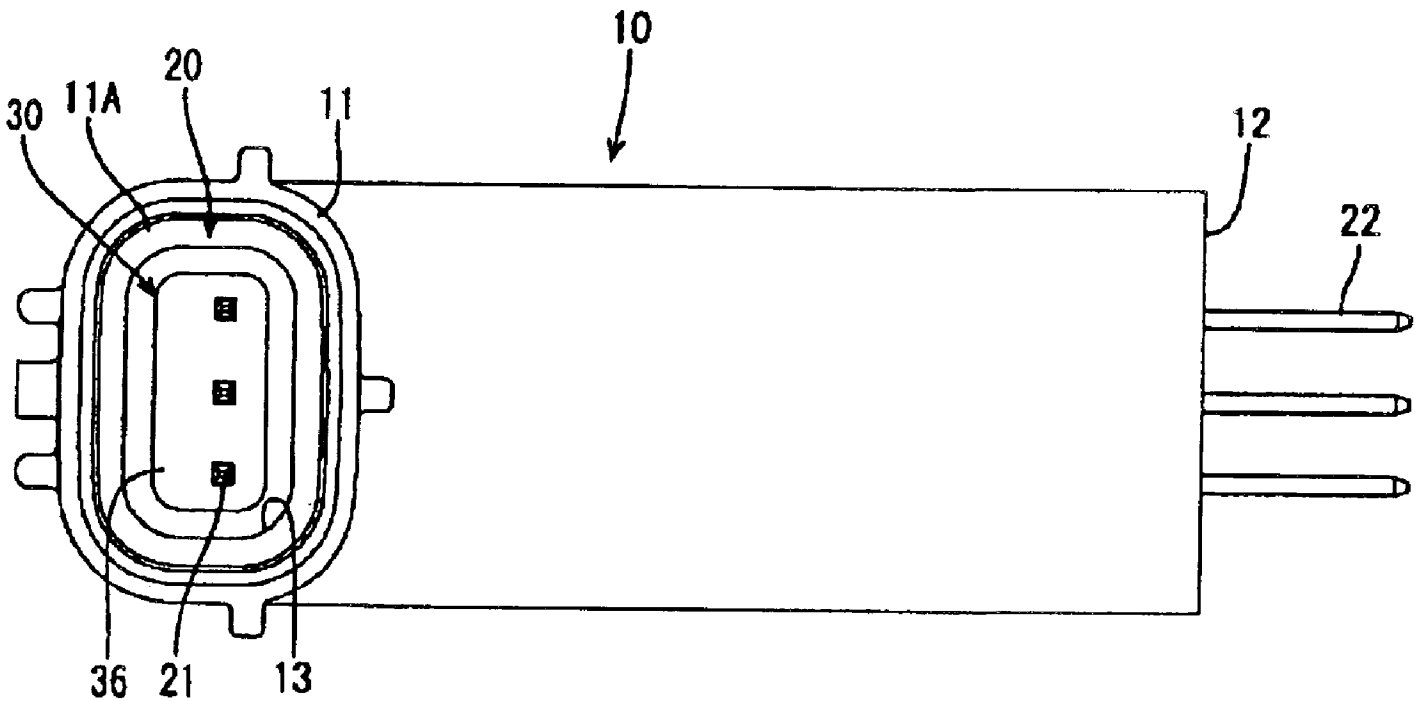
FIG. 2 is a plan view of the connector.

An insert-molded intermediate connector according to a first embodiment is described with reference to FIGS. 1 to 5. The intermediate connector has three terminal fittings 20 that are held by a core 30 to form a core assembly, and the resulting core assembly is incorporated into a housing 10, as shown in FIGS. 1 and 2.

The housing 10 is made e.g. of a synthetic resin and is substantially in the form of a bent or L-shaped tube with first and second connector fitting portions 11, 12 at the opposite ends. The first and second connector fitting portions 11 and 12 are substantially normal to each other. The first connector-fitting portion 11 is substantially in the form of a rectangular tube, and first tabs 21 at ends of the respective terminal fittings 20 project into the first connector-fitting portion 11. A mating female connector 40 is fittable into the first connector-fitting portion 11. The female connector 40 is comprised of a receptacle 41 fittable on the first connector-fitting portion 11. A projection 42 projects inside the receptacle 41 and fits into the first connector-fitting portion 11. An annular rubber ring 43 is mounted on the outer peripheral surface of the base end of the projection 42 of the female connector 40. In a fitted state of the female connector 40, the rubber ring 43 is held resiliently in close contact with the inner peripheral surface of the first connector-fitting portion 11, the projection 42 and/or the receptacle 41 to form a sealed area for sealing the inside of the first connector-fitting portion 11. On the other hand, second tabs 22 of the respective terminal fittings 20 project into the second connector-fitting portion 12. Although not shown in detail, another female connector is fittable into the second connector-fitting portion 12. In a fitted state of this female connector, a sealed area for sealing the inside of the second connector-fitting portion 12 is formed around the second tabs 22.

Figure 3:
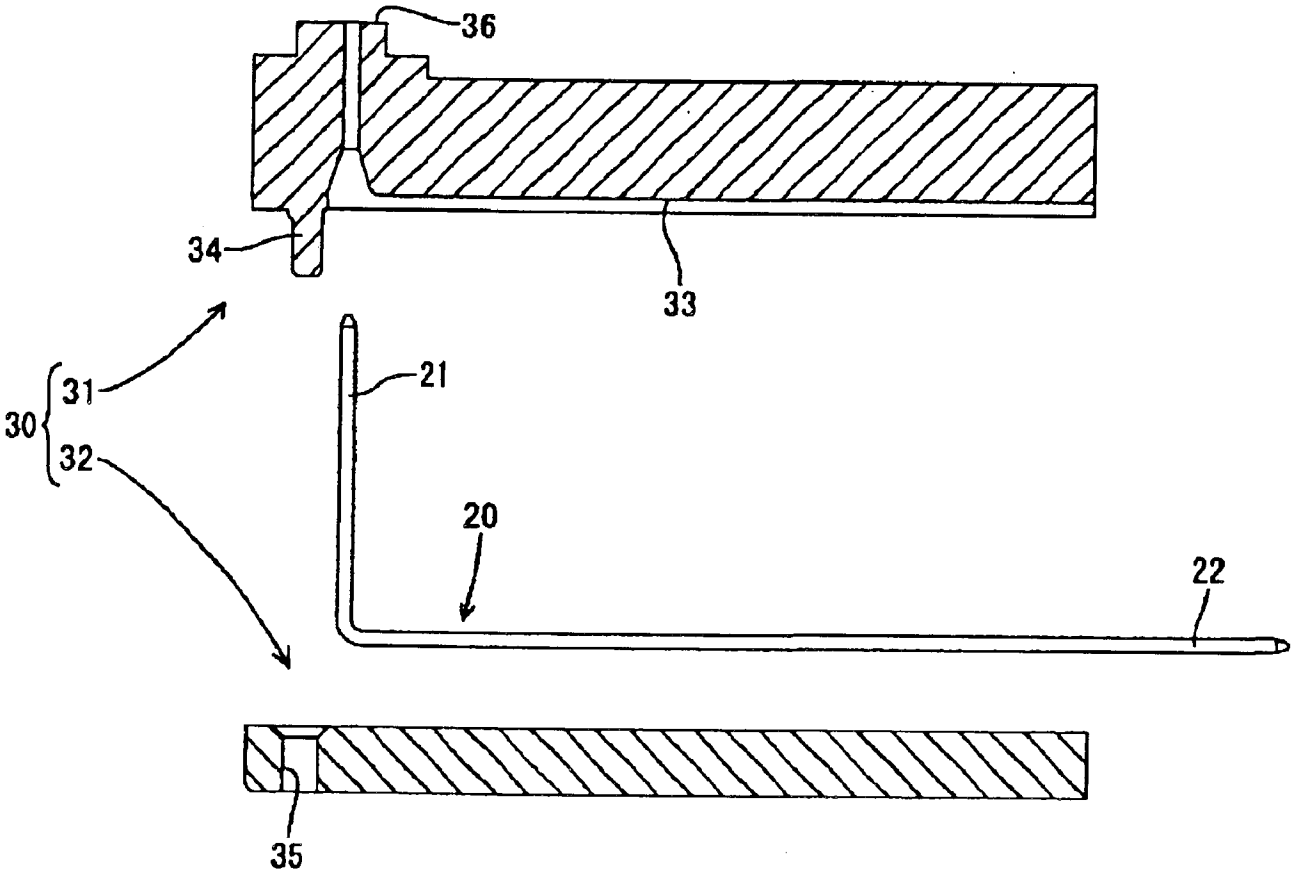
FIG. 3 is an exploded side view in section of a core and a terminal fitting.

The core 30 is formed e.g. of a synthetic resin and is separated longitudinally into first and second holding members 31, 32 as shown in FIG. 3. A terminal mounting groove 33 is formed in the bottom surface of the first holding member 31 for receiving the respective terminal fittings 20, and an engaging projection 34 projects down substantially normal to a plane of the first holding member 31 at a position adjacent to the terminal mounting groove 33. An engaging hole 35 penetrates the second holding member 32. The second holding member 32 is mounted to the bottom surface of the first holding member 31 to cover the bottom side of the terminal mounting groove 33 by fitting the engaging projection 34 into the engaging hole 35 for interlocking the holding members 31, 32.

A substantially rectangular opening 13 is formed in the middle of a back end surface 11A of the first connector fitting portion 11 of the housing 10, and a holdable portion 36 substantially having a mating shape projects from the upper surface of the first holding member 31 of the core 30 and into the opening 13. Most of the core 30 is covered by the tubular housing 10, and the holdable portion 36 is provided at a position exposed to outside through the opening 13 of the housing 10. The upper surface of the holdable portion 36 is substantially aligned with the back end surface 11A of the first connector fitting portion 11, and the outer diameter of the holdable portion 36 is smaller than the inner diameter of the opening 13 by a specified distance. Thus, a groove-shaped clearance is defined between the outer peripheral surface of the holdable portion 36 and the inner peripheral surface of the opening 13. The first tabs 21 of the terminal fittings 20 mounted in the terminal-mounting groove 33 project into the first connector-fitting portion 11 through the holdable portion 36.

The respective terminal fittings 20 are fitted into the terminal-mounting groove 33 of the first holding member 31 from a fitting side (e.g. from below), and then the second holding member 32 is fitted to the mounting surface (e.g. bottom surface) of the first holding member 31 to hold the respective terminal fittings 20 clamped or sandwiched between the first and second holding members 31, 32. In this way, the core 30 is completed and the respective terminal fittings 20 are held while having only the tabs 21, 22 exposed to outside.

Figure 4:
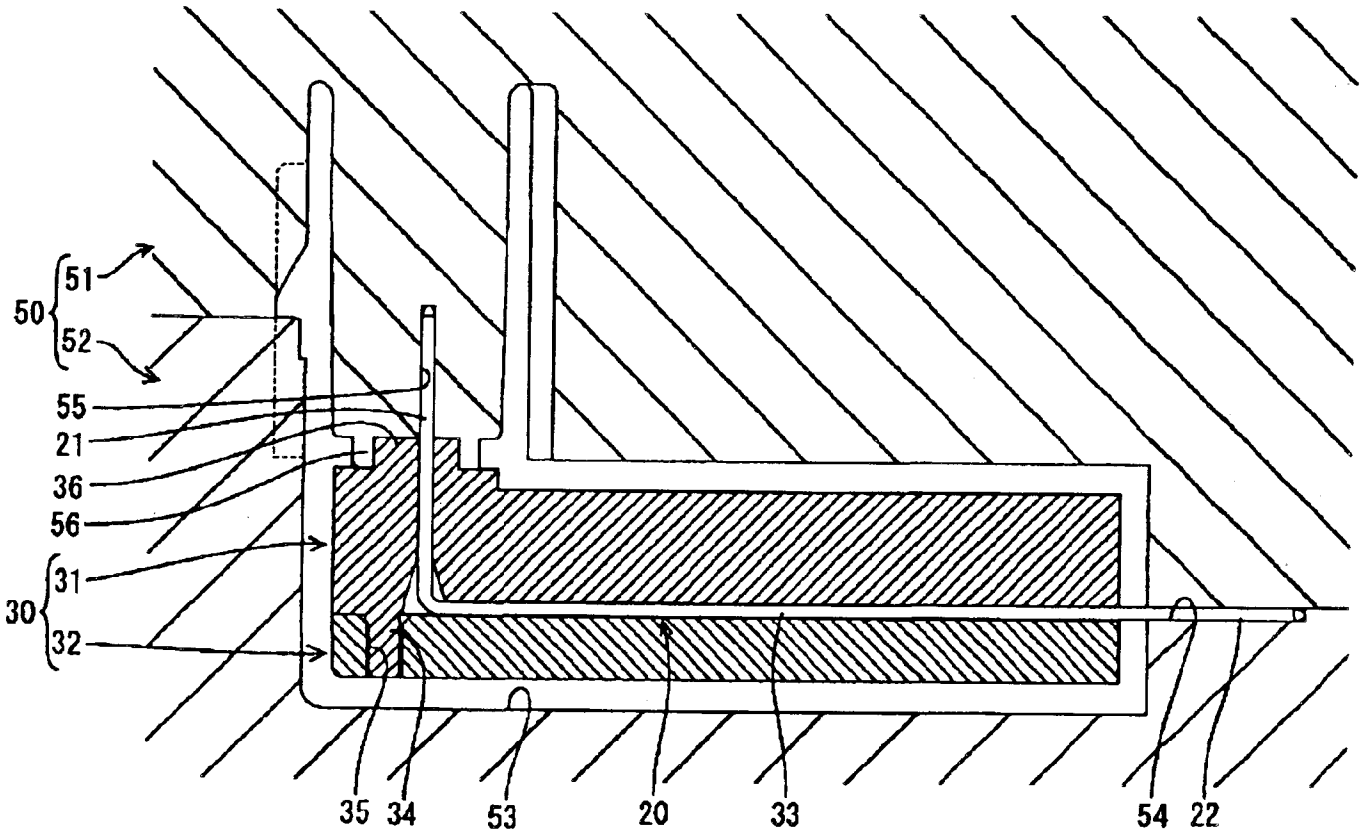
FIG. 4 is a side view in section showing a state where the core and the terminal fittings are set in a molding die.

The terminal fittings 20 and the core 30 then are set in a molding die 50 as shown in FIG. 4. The molding die 50 is comprised of at least one pair of molds 51, 52 that can be opened and closed vertically, and a cavity 53 is defined between the two molds 51, 52 for molding the housing 10. The mold 52 is formed with a mount groove 54 into which the second tabs 22 of the respective terminal fittings 20 are insertable. The mold 51 is formed with a mount groove 55 into which the first tabs 21 of the respective terminal fittings 20 are insertable. A holding portion 56 substantially in the form of a rectangular tube is closely fittable to the holdable portion 36 and projects around the opening of the mount groove 55.

The tabs 21, 22 at the opposite ends of the respective terminal fittings 20 are inserted into the mount grooves 54, 55 so that the terminal fittings 20 are held by the molding die 50. Further, the molding die 50 holds the core 30 by the engagement of the holdable portion 36 of the core 30 with the holding portion 56. In this state, a molten synthetic resin or similar molding material is injected to substantially fill the cavity 53. At this time, the core 30 and the terminal fittings 20 are subjected to an injection pressure of the resin. However, the core 30 cannot displace from a proper position because the core 30 and the terminal fittings 20 are held by the molding die 50.

Figure 5:
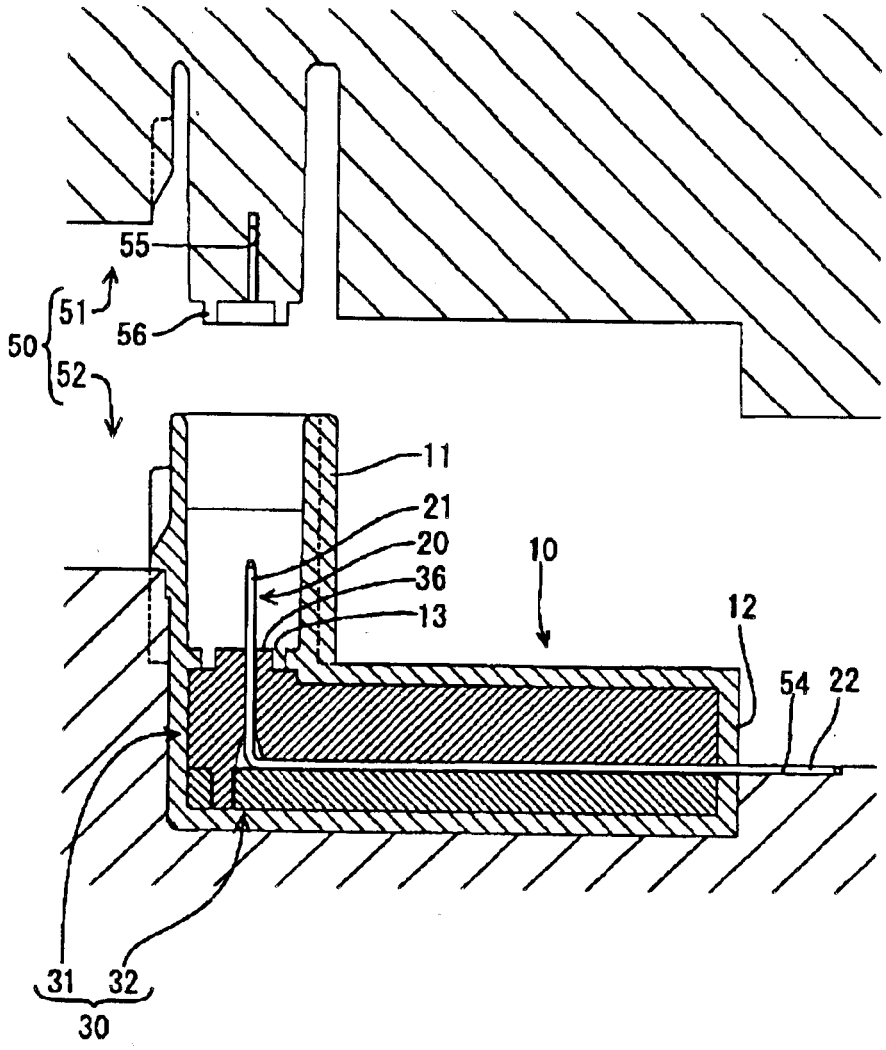
FIG. 5 is a side view in section showing a state where the molding die is opened after a housing is molded.

In this way, the housing 10 substantially in conformity with the shape of the cavity 53 is formed around the core 30. After the resin is cooled and solidified, a complete connector can be obtained by opening the molding die 50 as shown in FIG. 5 and taking a molded article out.

As described above, the core 30 has the holdable portion 36 and is held in the molding die 50 by engaging the holdable portion 36 with the holding portion 56. Thus, the injection pressure of the resin or similar molding material will not displace the core 30 from its proper position and a molding failure of the connector can be prevented.

Further, the housing 10 is formed with the opening 13 for exposing the holdable portion 36 of the core 30. Water may intrude into a small clearance between the core 30 and the housing 10 through the opening 13 if the connector is used in a place where it is exposed to water. As a countermeasure, the holdable portion 36 is located in the sealed area of the connector-fitting portion 11 defined between the connector fitting portion 11 and the mating female connector 40 according to this embodiment. Thus, the entrance of water through the opening 13 can be prevented.

Figure 6:
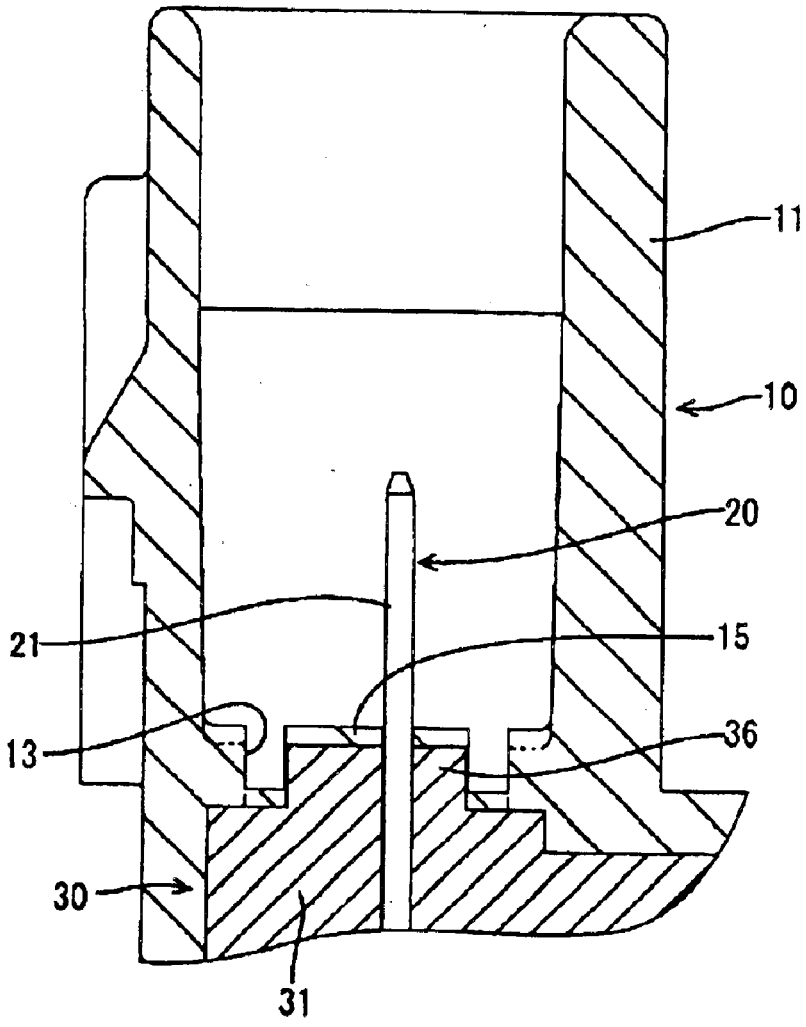
FIG. 6 is a side view in section showing a molding failure seen in a connector according to a second embodiment of the invention.

A second embodiment of the present invention is described with reference to FIG. 6. An insert-molded connector of this embodiment has the core 30 formed e.g. of a synthetic resin material having a color different from that of the housing 10. Since the other construction is similar to or the same as the first embodiment, no repetitive description is given thereon by identifying it by the same reference numerals.

The molding of the housing 10 may be carried out without setting the core 30 at a proper position. For example, the housing 10 may be molded with the core 30 inclined down from the proper position because the terminal fittings 20 were not inserted up to the back end of the mount groove 55 of the molding die 50. Thus, the resin forming the housing 10 is filled at a position where the holdable portion 36 should be located, and a resin 15 of the housing 10 covers the upper surface of the holdable portion 36 as shown in FIG. 6. However, the housing 10 and the core 30 are molded of resins of different colors, and the color of the resin of the housing 10 can be seen instead of that of the resin of the core 30 at the position of the holdable portion 36 in a defectively molded article, as shown in FIG. 6. Thus, according to this embodiment, whether or the connector has been molded properly can be detected by looking at the position of the holdable portion 36 of a molded article to check the color.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Figure 7:
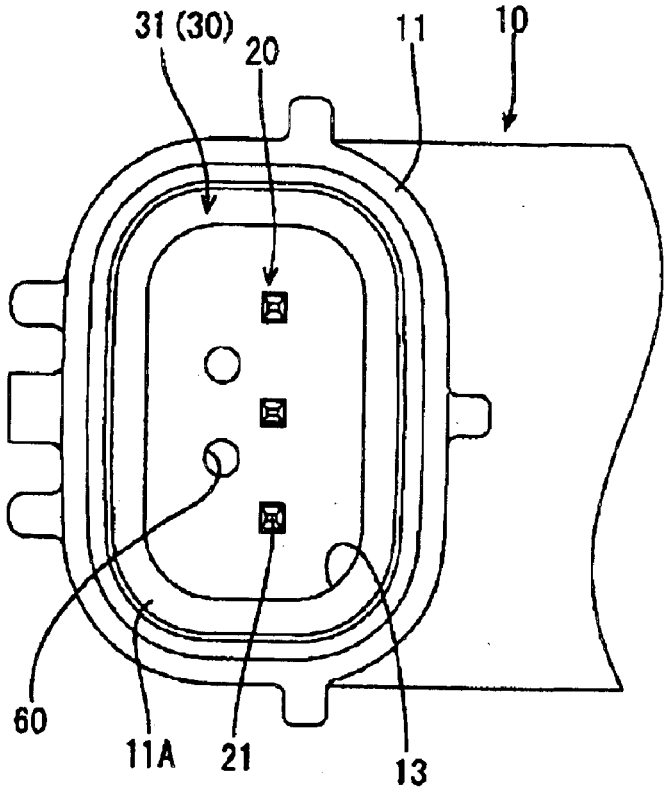
FIG. 7 is a plan view showing a connector according to another embodiment.
Figure 8:
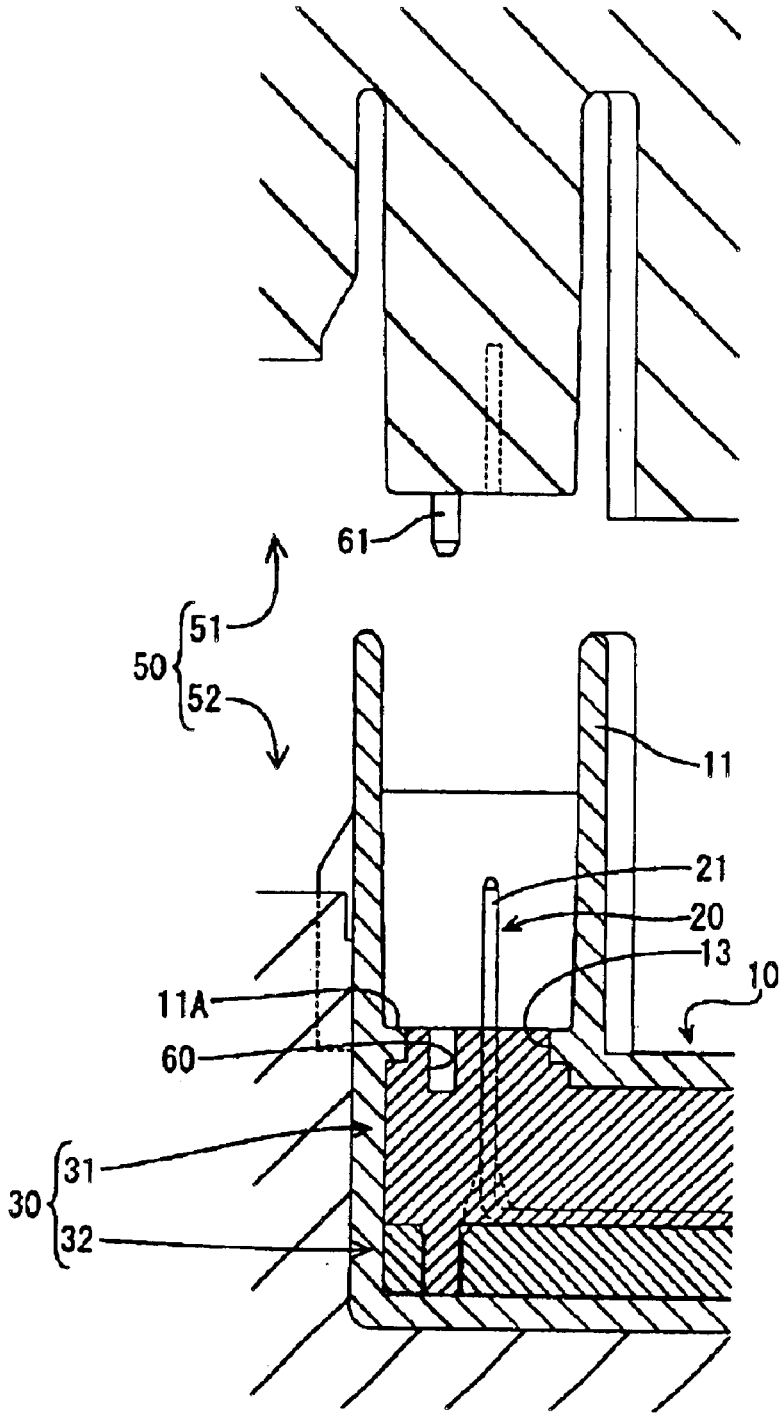
FIG. 8 is a side view in section showing the connector of FIG. 7 and a molding die.
Figure 9:
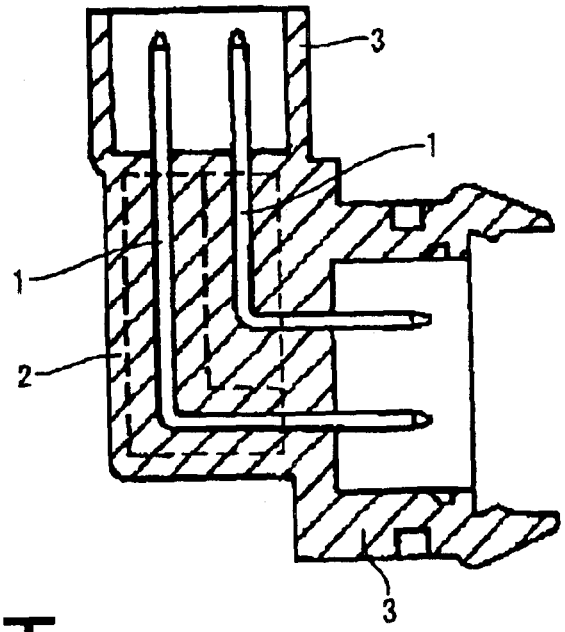
FIG. 9 PRIOR ART
FIG. 9 is a side view in section showing a prior art connector.
Figure 10:
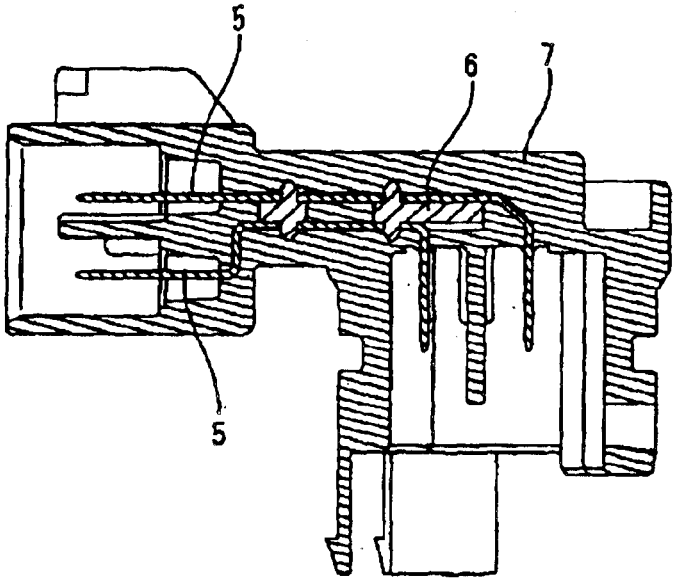
FIG. 10 PRIOR ART
FIG. 10 is a side view in section showing another prior art connector.

Although the holdable portion of the core in the form of a rectangular parallelepiped projects in the foregoing embodiments, the shape, number, position and the like thereof can be suitably changed. For example, the core 30 may be held by forming one or more, preferably a pair of insertion holes 60 as a holdable portion in the surface of the core 30 in abutment against the back end surface 11A of the connector fitting portion 11 and inserting substantially pin-shaped holding portions 61 projecting from the molding die 51 into the insertion holes 60 as shown in FIGS. 7 and 8. If the core 30 and the housing 10 are molded of resin materials having different colors even when the above arrangement is taken, whether the connector has been properly molded can be detected by checking the color of the insertion holes 60 of the core 30 and the color of a portion around the insertion holes 60 in a molded article. It should be noted that the similar or substantially same construction as the foregoing embodiments are identified by the same reference numerals in the connector shown in FIGS. 7 and 8.

Although the invention is applied to an intermediate connector in the foregoing embodiments, the invention can be applied to connectors in general used for other applications. For example, even a bulb socket formed by incorporating a pair of terminal fittings into a housing and providing a bulb mounting opening at one end and a connector fitting portion at the other end can be seen as a connector in a broader sense and can be embraced by the invention.

The number of terminal fittings to be incorporated into a connector can be set at a desired number.

It should be understood that even though in the preceding embodiment the terminal mounting groove for mounting the terminal fittings is provided on one holding member it may be provided substantially symmetrically on both holding members.

What is claimed is:

1. An insert-molded connector, comprising: at least one terminal fitting having opposite first and second longitudinal ends, a core formed from first and second holding members assembled around portions of the terminal filling between the first and second longitudinal ends so that the first and second longitudinal ends of the terminal fitting project beyond first and second ends of the core, portions of the core at the first end defining a holdable portion, and a housing molded into engagement with all external surface areas of the core except the holdable portion and molded into surrounding engagement with a portion of the terminal fitting between the second end of the core and the second longitudinal end of the terminal fitting, whereby the holdable portion of the core is supportable during molding of the housing around the core and the terminal fitting.

2. The insert-molded connector of claim 1, wherein the housing comprises a connector fitting portion engageable with a mating connector, and the holdable portion is located in a sealed area of the connector fitting portion defined between the connector fitting portion and a mating connector.

3. The insert-molded connector of claim 1, wherein the housing and the core are molded of synthetic resin materials having different colors.

4. Then insert-molding connector of claim 1, wherein the holding members comprise interlocking means for interlocking the holding members to each other.

5. The insert-molded connector of claim 1, wherein the terminal fitting includes a substantially right angle bend, the bend being disposed between the first and second holding members.

6. The insert-molded connector of claim 1, wherein the terminal fitting is directly engaged by each of said first and second holding members.

7. A method of molding an insert-molded connector, comprising the following steps:

providing at least one terminal fitting having opposite first and second longitudinal ends;

providing a core having first and second holding members;

assembling the first and second holding members around portions of the terminal fitting between the first and second longitudinal ends so that the first longitudinal end of the terminal fitting projects from a first end of the core and so that the second longitudinal end of the terminal fitting projects from a second end of the core, a portion of the first end of the core defining a holdable portion;

arranging a first molding die relative to the core so that the first molding die engages the holdable portion for supporting the core and, the first molding die further surrounding a first portion of the core while leaving a first cavity between the first molding die and the first portion of the core;

arranging a second molding die around a second portion of the core while leaving a second cavity between the second molding die and the second portion of the core;

molding a housing at least partly in the first and second cavities so that the housing covers all of the core except for the holdable portion at the first end of the core.

8. The method of claim 7, wherein the housing and the core are molded of synthetic resin materials having different colors.

9. The method of claim 7, wherein the molding die comprises mount grooves for positioning the terminal fitting during the molding.

10. The method of claim 9, wherein the core comprises at least two holding members and wherein the terminal fitting is at least partly fitted at least into a terminal mounting groove of one holding member and then another holding member is fitted to the mounting surface of the holding member for holding the terminal fitting at least partly clamped between the holding members.

* * * * *